US006227132B1

(12) United States Patent
Garcia

(10) Patent No.: US 6,227,132 B1
(45) Date of Patent: May 8, 2001

(54) BOAT DRAIN PLUG WITH CABLE TETHER

(76) Inventor: Curtis Garcia, 15563 Willow Dr., Fontana, CA (US) 92337

( * ) Notice: Subject to any disclaimer, the term of this patent is extended or adjusted under 35 U.S.C. 154(b) by 0 days.

(21) Appl. No.: 09/616,623

(22) Filed: Jul. 14, 2000

(51) Int. Cl.[7] ..... B63B 13/00
(52) U.S. Cl. ..... 114/197; 251/263
(58) Field of Search ..... 114/183, 197, 114/198, 227; 220/235; 251/263

(56) References Cited

U.S. PATENT DOCUMENTS 3,812,810 * 5/1974 Moeller ..... 114/197
4,516,515 * 5/1985 Johnson ..... 114/197
4,693,690 * 9/1987 Henderson ..... 114/197
5,966,080 * 10/1999 Bigsby ..... 114/197

* cited by examiner

*Primary Examiner*—Jesus D. Sotelo
(74) *Attorney, Agent, or Firm*—Goldstein & Canino

(57) ABSTRACT

A boat drain plug with cable tether including a cylindrical plug portion adapted for coupling with the drain of the boat. The cylindrical plug portion has an upper end, a lower end, and a cylindrical side wall therebetween. The upper end has a block secured thereto. The block has an aperture therethrough. The lower end is receivable within the drain. A length of safety cable is provided that is formed into a lower loop and an upper loop. The lower loop is coupled with the aperture of the block of the plug portion. A swivel loop is provided having a central pivot member with opposed upper and lower looping members. The lower looping member couples with the upper loop of the length of safety cable. A safety line is provided having an upper end and a lower end. The lower end couples with the upper looping member of the swivel loop. The upper end is couplable with the tie down cleat of the boat.

4 Claims, 3 Drawing Sheets

BOAT DRAIN PLUG WITH CABLE TETHER

BACKGROUND OF THE INVENTION

The present invention relates to a boat drain plug with cable tether and more particularly pertains to preventing a boat's drain plug from being lost.

The use of drain plug devices is known in the prior art. More specifically, drain plug devices heretofore devised and utilized for the purpose of connecting with the drain plug to prevent misplacing are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,516,515 to Johnson discloses a boat plug with a connector chain incorporated and means to remind the user of the condition of the plug. U.S. Pat. No. 4,216,558 to Schultz discloses a water inlet adapter valve for a boat with a chain secured to the plug. U.S. Pat. No. 4,843,376 to Wagner and U.S. Pat. No. 4,986,502 to Ceroke disclose additional drain plug apparatus'.

While these devices fulfill their respective, particular objective and requirements, the aforementioned patents do not describe a boat drain plug with cable tether for preventing a boat's drain plug from being lost.

In this respect, the boat drain plug with cable tether according to the present invention substantially departs from the conventional concepts and designs of the prior art, and in doing so provides an apparatus primarily developed for the purpose of preventing a boat's drain plug from being lost.

Therefore, it can be appreciated that there exists a continuing need for a new and improved boat drain plug with cable tether which can be used for preventing a boat's drain plug from being lost. In this regard, the present invention substantially fulfills this need.

SUMMARY OF THE INVENTION

In the view of the foregoing disadvantages inherent in the known types of drain plug devices now present in the prior art, the present invention provides an improved boat drain plug with cable tether. As such, the general purpose of the present invention, which will be described subsequently in greater detail, is to provide a new and improved boat drain plug with cable tether which has all the advantages of the prior art and none of the disadvantages.

To attain this, the present invention essentially comprises a cylindrical plug portion adapted for coupling with the drain of the boat. The cylindrical plug portion has an upper end, a lower end, and an externally threaded cylindrical side wall therebetween. The upper end has a block secured thereto. The block has an aperture therethrough. The lower end is receivable within the drain with the externally threaded side wall mating with the internally threaded drain. A length of safety cable is provided that is formed into a lower loop and an upper loop by a pair of ferrules. The lower loop is coupled with the aperture of the block of the plug portion. A swivel loop is provided having a central pivot member with opposed upper and lower looping members. The lower looping member couples with the upper loop of the length of safety cable. A safety line is provided having an upper end and a lower end. The lower end couples with the upper looping member of the swivel loop. The upper end is couplable with the tie down cleat of the boat.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat drain plug with cable tether which has all the advantages of the prior art drain plug devices and none of the disadvantages.

It is another object of the present invention to provide a new and improved boat drain plug with cable tether which may be easily and efficiently manufactured and marketed.

It is a further object of the present invention to provide a new and improved boat drain plug with cable tether which is of durable and reliable construction.

An even further object of the present invention is to provide a new and improved boat drain plug with cable tether which is susceptible of a low cost of manufacture with regard to both materials and labor, and which accordingly is then susceptible of low prices of sale to the consuming public, thereby making such a boat drain plug with cable tether economically available to the buying public.

Even still another object of the present invention is to provide a new and improved boat drain plug with cable tether for preventing a boat's drain plug from being lost.

Lastly, it is an object of the present invention to provide a new and improved boat drain plug with cable tether including a cylindrical plug portion adapted for coupling with the drain of the boat. The cylindrical plug portion has an upper end, a lower end, and a cylindrical side wall therebetween. The upper end has a block secured thereto. The block has an aperture therethrough. The lower end is receivable within the drain. A length of safety cable is provided that is formed into a lower loop and an upper loop. The lower loop is coupled with the aperture of the block of the plug portion. A swivel loop is provided having a central pivot member with opposed upper and lower looping members. The lower looping member couples with the upper loop of the length of safety cable. A safety line is provided having an upper end and a lower end. The lower end couples with the upper looping member of the swivel loop. The upper end is couplable with the tie down cleat of the boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
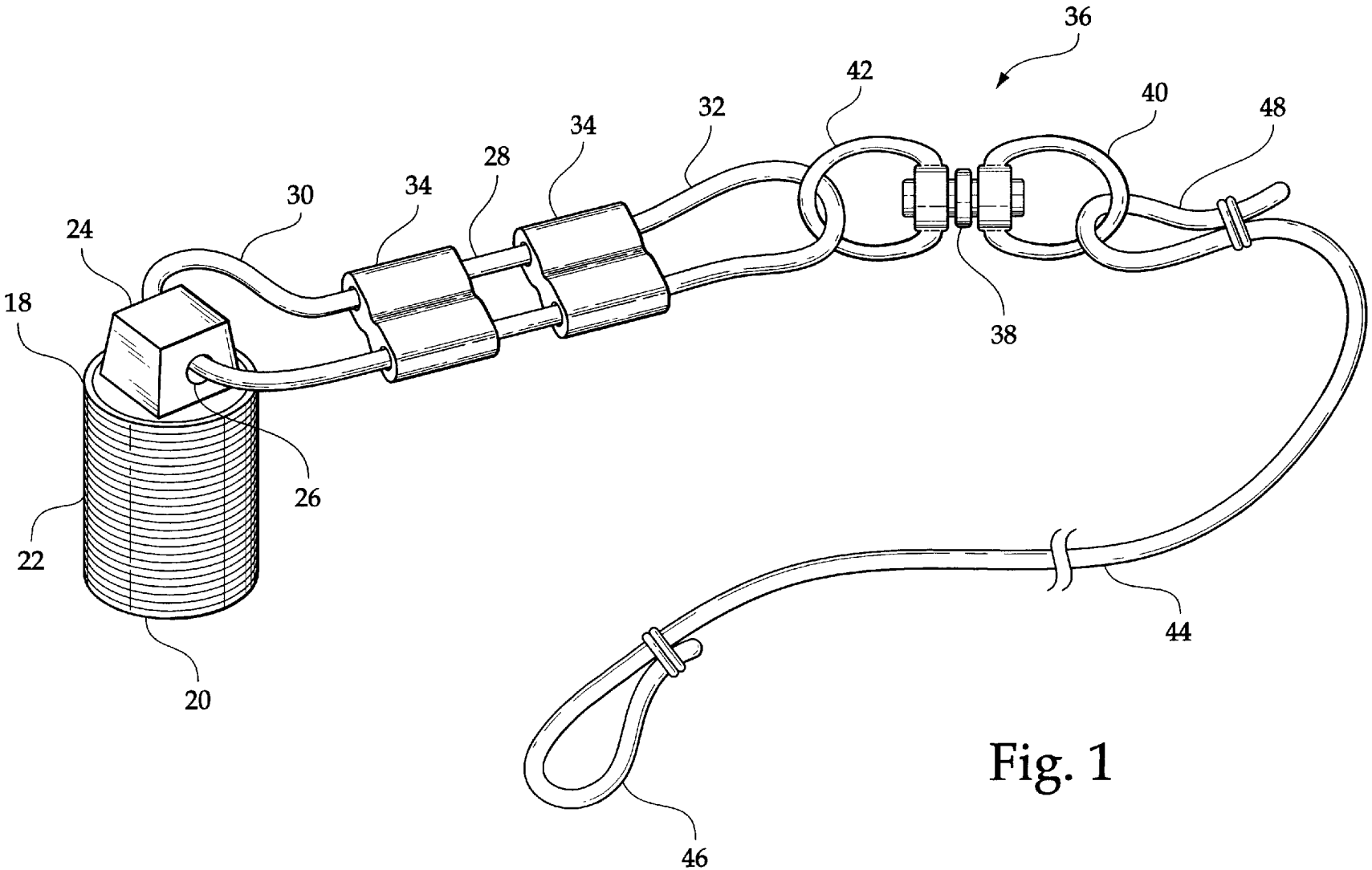
FIG. 1 is a perspective view of the preferred embodiment of the boat drain plug with cable tether constructed in accordance with the principles of the present invention.
Figure 2:
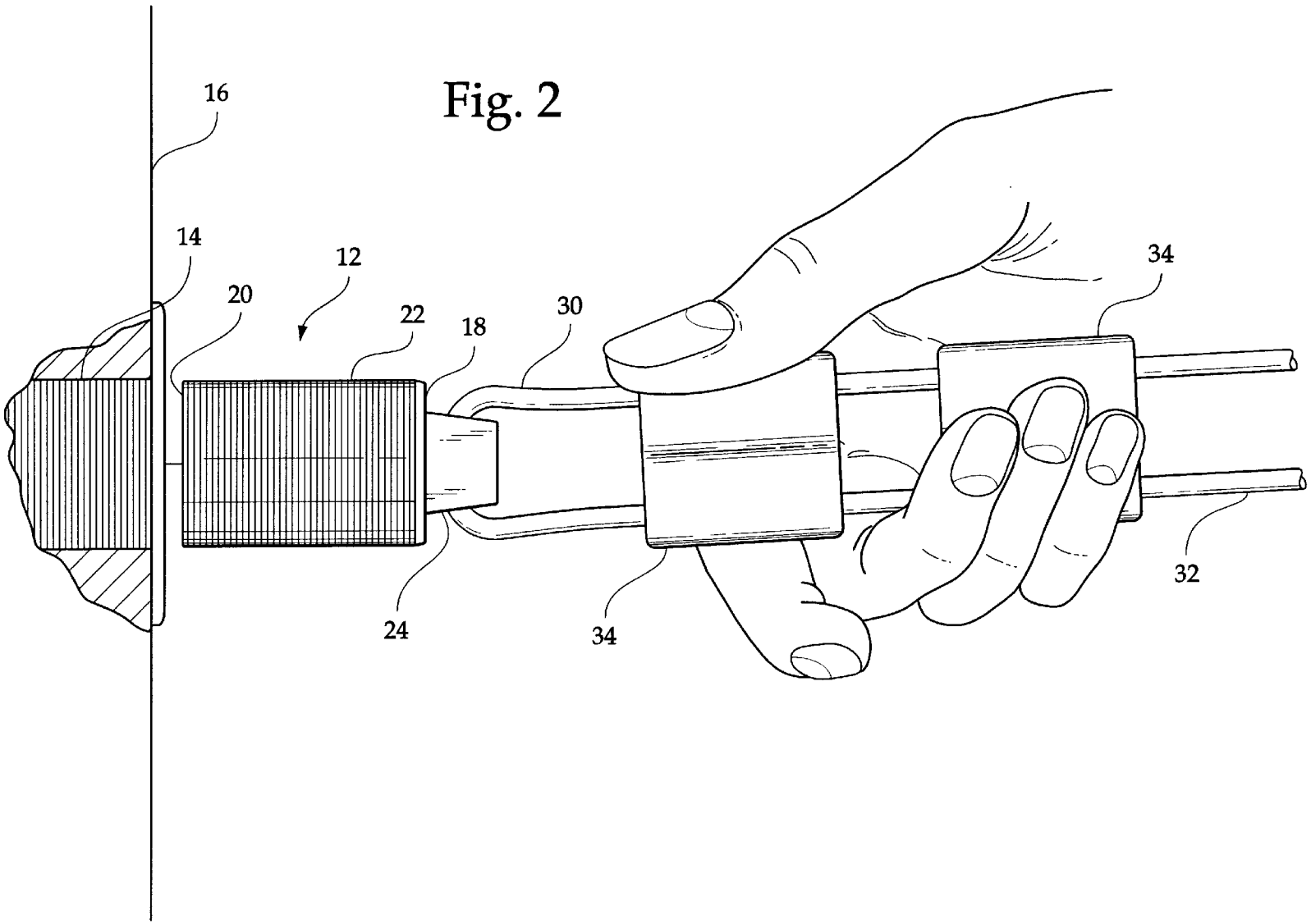
FIG. 2 is a side view of the present invention illustrated in use.
Figure 3:
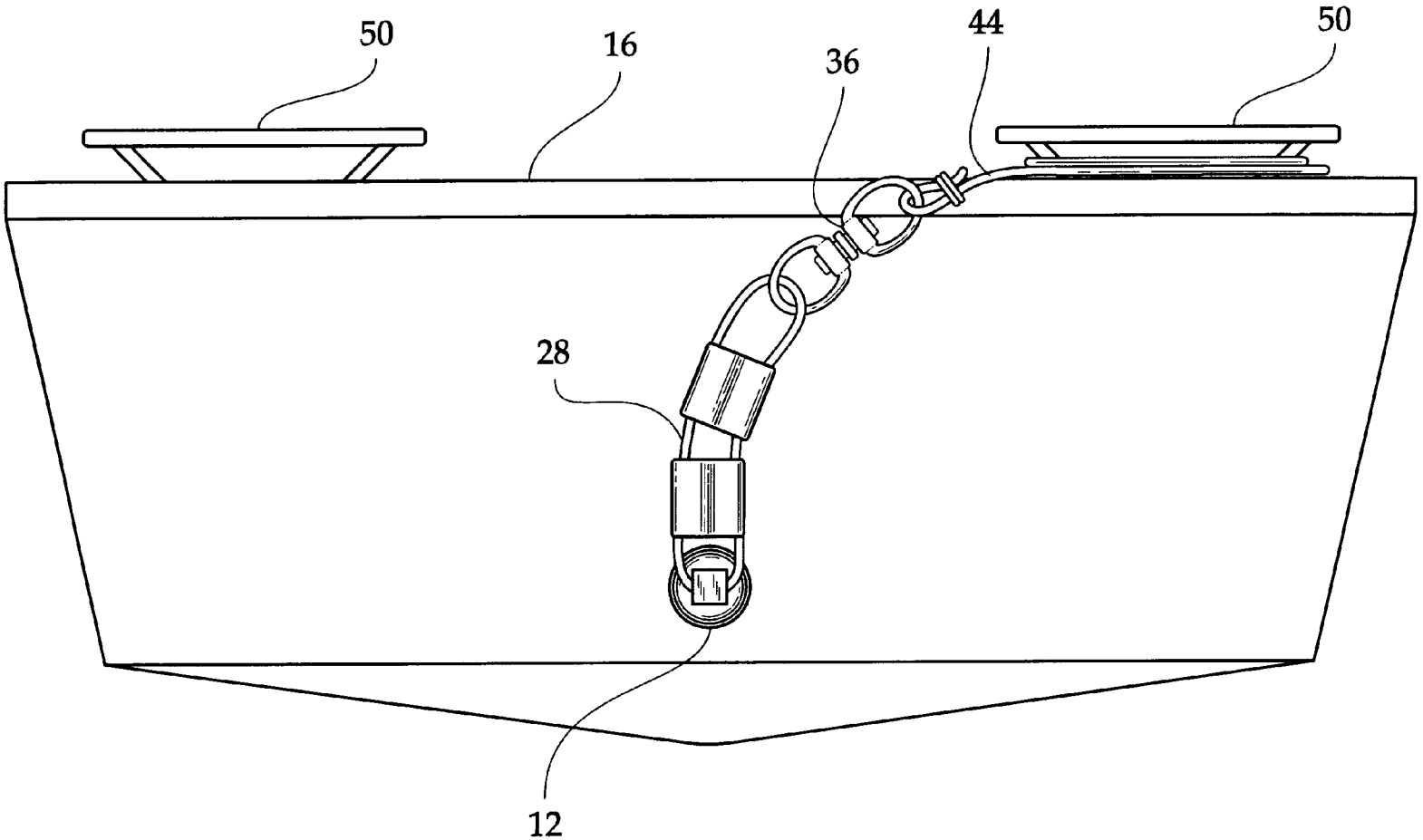
FIG. 3 is a front view of the present invention illustrate coupled with a boat.

With reference now to the drawings, and in particular, to FIGS. 1 through 3 thereof, the preferred embodiment of the new and improved boat drain plug with cable tether embodying the principles and concepts of the present invention and generally designated by the reference number 10 will be described.

Specifically, it will be noted in the various figures that the device relates to a boat drain plug with cable tether for preventing a boat's drain plug from being lost. In its broadest context, the device consists of a cylindrical plug portion, a length of safety cable, a swivel loop, and a safety line. Such components are individually configured and correlated with respect to each other so as to attain the desired objective.

The cylindrical plug portion 12 is adapted for coupling with the drain 14 of the boat 16. The cylindrical plug portion 12 has an upper end 18, a lower end 20, and an externally threaded cylindrical side wall 22 therebetween. The upper end 18 has a block 24 secured thereto. The block 24 has an aperture 26 therethrough. The lower end 20 is receivable within the drain 14 with the externally threaded side wall 22 mating with the internally threaded drain 14.

The length of safety cable 28 is formed into a lower loop 30 and an upper loop 32 by a pair of ferrules 34. The lower loop 30 is coupled with the aperture 26 of the block 24 of the plug portion 12. The size of the loops 30,32 can be adjusted by sliding the ferrules 34. Note FIG. 2.

The swivel loop 36 has a central pivot member 38 with opposed upper and lower looping members 40,42. The lower looping member 42 couples with the upper loop 32 of the length of safety cable 28.

The safety line 44 has an upper end 46 and a lower end 48. The lower end 48 couples with the upper looping member 40 of the swivel loop 36. The upper end 46 is couplable with the tie down cleat 50 of the boat 16.

In use, the plug portion 12 can be positioned within the drain 14 of the boat 16 when not draining in the boat 16. When draining the boat 16, the plug portion 12 can be removed to expose the drain 14 while at the same time remaining coupled with the tie down cleat 50 by the safety line 44 to prevent the plug portion 12 from becoming lost. The use of the swivel loop 36 prevents the safety line from becoming tangled upon movement of the boat 16.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat drain plug with cable tether for preventing a boat's drain plug from being lost, wherein the boat includes an internally threaded drain and at least one tie down cleat, the boat drain plug comprising, in combination:

a cylindrical plug portion adapted for coupling with the drain of the boat, the cylindrical plug portion having an upper end, a lower end, and an externally threaded cylindrical side wall therebetween, the upper end having a block secured thereto, the block having an aperture therethrough, the lower end being receivable within the drain with the externally threaded side wall mating with the internally threaded drain;

a length of safety cable formed into a lower loop and an upper loop by a pair of ferrules, the lower loop being coupled with the aperture of the block of the plug portion;

a swivel loop having a central pivot member with opposed upper and lower looping members, the lower looping member coupling with the upper loop of the length of safety cable; and a safety line having an upper end and a lower end, the lower end coupling with the upper looping member of the swivel loop, the upper end being couplable with the tie down cleat of the boat.

2. A boat drain plug with cable tether for preventing a boat's drain plug from being lost, wherein the boat includes a drain and at least one tie down cleat, the boat drain plug comprising, in combination:

a cylindrical plug portion adapted for coupling with the drain of the boat, the cylindrical plug portion having an upper end, a lower end, and a cylindrical side wall therebetween, the upper end having a block secured thereto, the block having an aperture therethrough, the lower end being receivable within the drain;

a length of safety cable formed into a lower loop and an upper loop, the lower loop being coupled with the aperture of the block of the plug portion;

a swivel loop having a central pivot member with opposed upper and lower looping members, the lower looping member coupling with the upper loop of the length of safety cable; and a safety line having an upper end and a lower end, the lower end coupling with the upper looping member of the swivel loop, the upper end being couplable with the tie down cleat of the boat.

3. The boat drain plug with cable tether as set forth in claim 2, wherein the cylindrical side wall of the plug portion is externally threaded for mating with internal threads on the drain of the boat.

4. The boat drain plug with cable tether as set forth in claim 2, wherein the length of safety cable is formed into the lower loop and the upper loop by a pair of ferrules.

* * * * *